US005336709A

United States Patent [19]

Antikow et al.

[11] Patent Number: 5,336,709

[45] Date of Patent: Aug. 9, 1994

[54] UNDRAWN PRE-ORIENTED PET YARNS WITH IMPROVED PRODUCTION EFFICIENCY

[75] Inventors: Paul Antikow, Lyon; Francois Pinaud, Brignais, both of France

[73] Assignee: Rhone Poulenc Fibres, Lyon, France

[21] Appl. No.: 955,039

[22] Filed: Oct. 1, 1992

Related U.S. Application Data

[62] Division of Ser. No. 626,766, Dec. 13, 1990, Pat. No. 5,207,959.

[30] Foreign Application Priority Data

Dec. 20, 1989 [FR] France ..... 89 17216

[51] Int. Cl.[5] ..... C08K 3/34; D02G 3/00

[52] U.S. Cl. ..... 524/493; 428/364; 428/365; 428/372; 264/103

[58] Field of Search ..... 524/493, 494; 428/364, 428/365, 372; 264/103

[56] References Cited

U.S. PATENT DOCUMENTS 3,998,988 12/1976 Shimomai et al. ..... 428/400
4,547,546 10/1985 Wells ..... 524/313

FOREIGN PATENT DOCUMENTS 140559 5/1985 European Pat. Off. .
3066322 3/1988 Japan ..... 428/372

OTHER PUBLICATIONS

Abstract of Japanese Reference 60-246813 (Published Dec. 1985).

*Primary Examiner*—Paul R. Michl
*Assistant Examiner*—LaVonda Dewitt
*Attorney, Agent, or Firm*—Sherman and Shalloway

[57] ABSTRACT

Undrawn preoriented polyester yarns containing 0.03 to 0.01% of fumed silica with a particle size of between 5 and 15 nm, exhibit a delay in crystallization.

4 Claims, 2 Drawing Sheets

UNDRAWN PRE-ORIENTED PET YARNS WITH IMPROVED PRODUCTION EFFICIENCY

This is a division of application Ser. No. 07/626,766, filed Dec. 13, 1990, now U.S. Pat. No. 5,207,959.

BACKGROUND OF THE INVENTION

1. Field of the Invention

The present nvention relates to a process which has better production efficiency for obtaining undrawn filaments based on polyethylene terephthalate It also relates to PET-based undrawn modified yarns suitable for texturing by false twist drawing.

2. Description of the Prior Art

The undrawn polyester yarns which can generally be employed for the drawing-texturing operation using false twist must exhibit low crystallinity and orientation properties, so as to orient the molecules better and then to crystallize and thus set the orientation during the drawing-texturing process without degrading or breaking the filaments during the heat-setting of the yarn.

For example, it is known according to French Patent 2,151,896 that undrawn and preoriented polyester yarns (PET-POY) which can be directly employed for texturing using false twist can be obtained directly by spinning when the spinning rates and the cooling conditions are chosen appropriately. Filaments which have a desired orientation, elongation at break and crystallinity are thus obtained. The recommended spinning velocities are preferably between 2750 and 3200 m/min, but lower than 4000 m/min to prevent the strand breakages which arise during the spinning. It is generally accepted that at 4000 m/min a beginning of crystalline orientation is produced, limiting the production of the PET POY yarns to this velocity.

This is why tests have been carried out to improve the production efficiency during the spinning of PET POY yarns by introducing into the molten PET (melt) various polymers in the form of immiscible particles: for example European Patent EP 47,464 envisages the introduction of 0.2 to 10% of polyacrylate or polymethacrylate of molecular weight ≧1000 and EP 80,274 envisages the introduction of polyamide or polyethylene forming microfibrils in the filaments obtained. However, the addition of polymer in the form of fine particles presents disadvantages when applied on an industrial scale; in particular, it demands a highly sophisticated technology for obtaining mixtures which have sufficient fineness and stability with time to permit a reliable spinning without strand breakages. A technique of this kind cannot, in fact, be employed industrially.

It is also known to improve the production efficiency of undrawn polyester yarns by introducing into the polymer chain reactive sites originating from tri- or tetravalent compounds.

For example, French Patent 2,355,930 envisages the introduction of 1–15 meq of chain branching reactive sites/1 g of polymer by means of compounds such as pentaerythritol, trimesic acid, trimethylolpropane, pyromellitic acid or their esters.

EP 0,263,603 also proposes to prepare polyesters containing 2–6 meq (per g of PET) of trimesic or trimellitic acid or their esters, to obtain preoriented yarns suitable for texturing.

The use of such compounds modifies the rheology of the polymer by increasing its viscoelasticity so that the spinning of such copolymers becomes very tricky and involves major risks of strand breakages. Moreover, it is known according to EP 140,559 to prepare highly oriented and drawn polyester-based yarns containing particulate silicas which have a mean particle size smaller than 1 micron and which, after spinning and solidifying, are subjected to a conditioning in a gaseous atmosphere maintained at a temperature between 90 and 200° C. so as to produce their crystallization. The filaments obtained thus exhibit an improved uniformity.

BRIEF DESCRIPTION OF THE DRAWING FIGURES

DETAILED DESCRIPTION OF THE INVENTION

Figure 1:
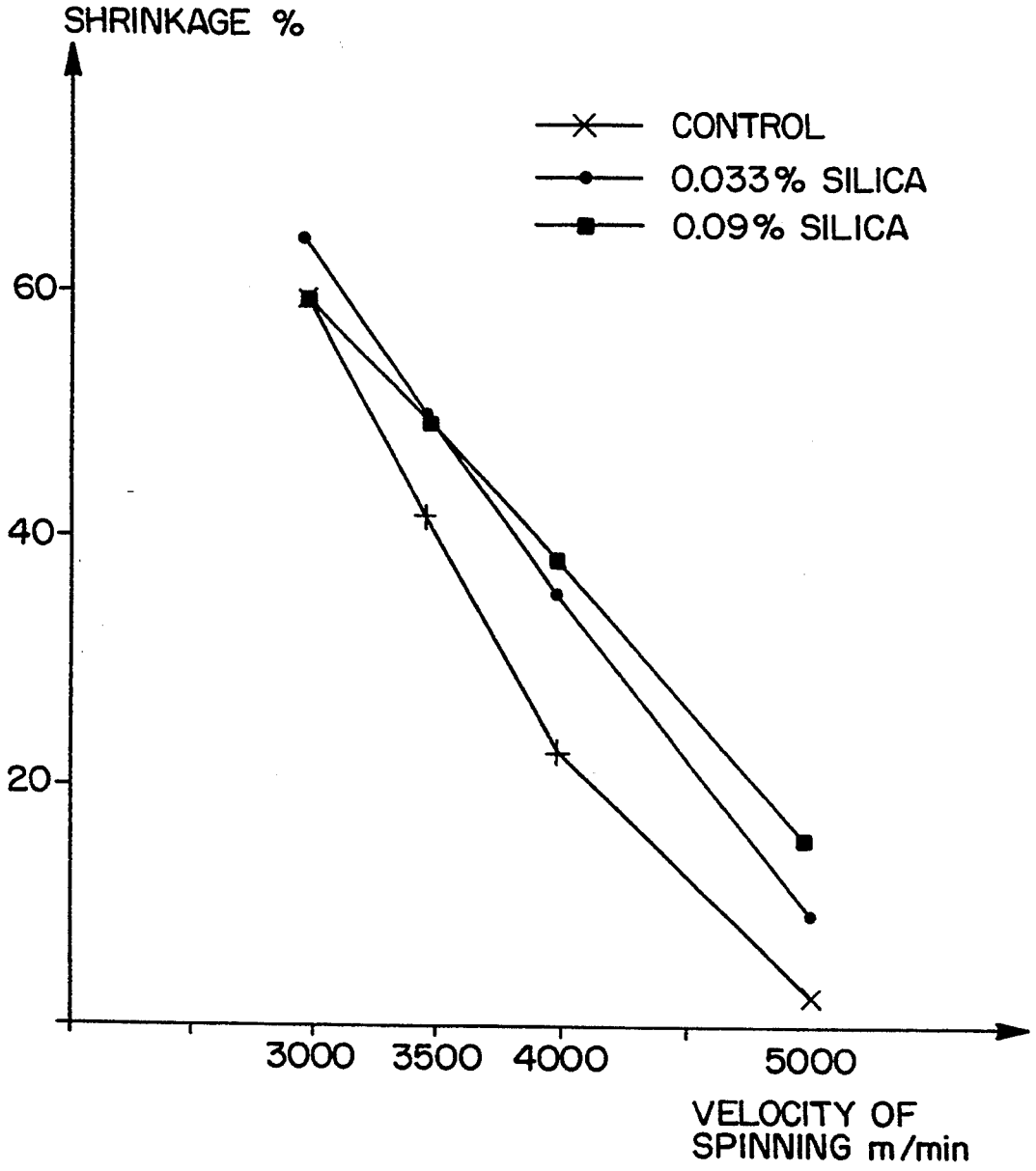
FIG. 1 is a graph showing the shift in shrinkage values as a function of velocity of spinning for various yarns in accord with the present invention and a control yarn.

The subject of the present invention is the preparation of preoriented, undrawn PET-based yarns with an improved production efficiency.

More particularly, it relates to a process for improving the production efficiency of melt-spinning of a PET-based undrawn preoriented yarn at a velocity of at least 3500 m/min, by incorporation into the molten PET, before spinning, of 0.03 to 0.1% by weight of fumed silica with a mean elementary particle size of between 5 and 15 nm (50 and 150 Å), introduced in the form of dispersion at a concentration of 2–10% in a masterbatch of the polyester to be processed, followed by melt-spinning of the PET containing the finely dispersed silica, the filaments being then cooled by means of a gas stream at temperature between 17 to 22° C., sized in the usual way and then wound directly at a velocity of between 3500 and 5000 m/min.

The gain in production efficiency is calculated on the basis of the shrinkage of the yarn at 180° C. in dry air; it corresponds to an increase in the velocity of winding up of at least 7%, preferably >10%–15% or even more.

The yarns are generally interlaced before being wound. The winding velocity is preferably between 4000 and 5000 m/min.

The present invention also relates to PET-based, undrawn, preoriented filaments containing 0.03 to 0.1% by weight of silica with a particle size of between 5 and 15 nm (50 and 150 Å), distributed uniformly in the polymer, exhibiting a delay in crystallization and orientation.

In the description, "polyethylene terephthalate" (PET) or "polyester" means the polyesters containing at least 80% of polyethylene terephthalate units and 20% of units derived from a diol other than ethylene glycol, such as diethylene glycol, tetramethylene glycol or from an acid other than terephthalic acid, for example isophthalic, hexahydroterephthalic or dibenzoic acid, and the like.

The polyethylene terephthalate may be optionally modified with small molar quantities of a branching agent containing 3 to 4 alcohol or acid functional groups such as trimethylolpropane, trimethylolethane, pentaerythritol, glycerins or trimesic, trimellitic or pyromellitic acid; the starting polyester may also contain known additives, such as agents stabilizing against light or heat, additives intended to reduce static electricity, to modify the dyeability, such as sodium 3,5-dicarboxybenzenesulphonate, delustering agents such as titanium dioxide, and the like.

The polyethylene terephthalate employed according to the present invention exhibits an intrinsic viscosity of between 0.5 and 0.75, perferably between 0.6 and 0.7, determined on a solution at a concentration of 0.5% by weight in a phenol/tetrachloroethane mixture at 25° C. The intrinsic viscosity is the limit at zero concentration of the specific viscosity/concentration:

specific viscosity=(t—to)/toC t=flow time of the polymer solution to=flow time of the solvent mixture C=concentration of the polymer in the solvent mixture The measurement is carried out by means of a viscometer of the Ubbelohde type.

Under the expression pyrogenic silica there is understood the silicon dioxide obtained by combustion of an organosilicon compound and available commercially under various trademarks such as the Aerosil 300 type from the Degussa company. The silicas are ultrafine fillers which are in the form of aggregates consisting of elementary particles with a specific surface area of between 100 and 450 $m^2/g$, whose size is between 5 and 15 nm (50 and 150 Å), more generally of the order of about a hundred Å and assembled into linear chains.

According to the invention the fumed silica is mixed with dry PET identical with the polyester to be processed in a melt-blending apparatus such as a twin-screw extruder or any suitable device, in proportions such that a masterbatch containing 1–10% of silica, preferably 1–5% is obtained in the form of granules at 275°–290° C., preferably about 280°–285° C. The masterbatch granules thus obtained contain silica which is distributed very uniformly. This distribution can already be observed with an electron microscope at the masterbatch or final mixture stage. They are introduced in various proportions, depending on the proportion of silica desired in the PET melt before the spinning, for example by means of a blending twin-screw extruder heated to between 270 and 290° C. or any other suitable means.

The spinning is carried out at temperatures which are usual in the case of PET between 275 and 290° C., preferably close to 280° C. and the filaments are cooled under the die with a cooling gas stream and are then sized and wound at velocities between 3500 and 5000 m/min. The cooling conditions may vary as a function of the cooling device employed, of the precise spinning velocity, of the count and number of filaments, these settings being within the scope of a person skilled in the art.

The filaments are preferably interlaced and/or intermingled before winding, for a better subsequent windability.

Surprisingly and unexpectedly, the process according to the invention makes it possible to obtain preoriented, undrawn filaments with an improved production efficiency of more than 7%, generally more than 10 or 15% or even more, due to a delay in crystallization and orientation of the filaments: that is to say that at the same degree of crystallization of the filaments, the winding velocity is more than 7%, generally 10 to 15% or even more.

Scientific studies show that up to approximately 4000 m/min an increase in the spinning velocity is reflected essentially in an increase in the molecular orientation of the yarns. Above approximately 4000 m/min a crystalline orientation appears, which is produced essentially by the stress of spinning, which is above all a function of the tension speed and of the count of the filaments, and which limits to this speed the production of preoriented polyester yarns suitable for drawing and false-twist texturing. When PET yarns are obtained at velocities of between 3000 and 6000 m/min, the increase in the crystallinity results in a progressive reduction in the heat shrinkage which drops from approximately 60% to a few per cent at 5000 m/min. It is assumed that the crystallites set the structure in a form extended by branchings which can only be destroyed by heat at the melting point of the polymer.

According to the present invention it has surprisingly been found that the introduction of 0.03 to 0.1% of fumed silica caused a delay in the decrease in the shrinkage of the filaments as a function of the spinning velocity, a delay which corresponds to a delay in the orientation and in the crystallization of the yarns obtained along the spinning line. This delay in the crystallization makes it possible to obtain undrawn preoriented yarns which have characteristics identical with those obtained at velocities which are lower by at least 7%, preferably 10–15% or even more, calculated in relation to the values of shrinkage in dry air at 180° C.

The measurement or shrinkage consists in determining the change in length of a sample of yarn under a pretension of 50 mg/tex after a treatment of 30 minutes in an oven at 180° C.

FIG. 1 shows the shift in the shrinkage values as a function of the velocity of spinning in the case of yarns filled with 0.03 and 0.09% of silica respectively, compared with a control yarn of the same polyester, unfilled.

A less direct way of demonstrating the delay in the orientation of the preoriented yarns is the measurement of the sonic modulus after treatment of the yarns without stress at 100° C. for 2 minutes, the objective of the heat treatment being to exacerbate the phenomenon. It bears witness to the macromolecular orientation of the substance of the yarn. It is based on the measurement of the electrical phase change caused by the changes in the lengthwise mechanical wavelength of a yarn which runs between a probe emitting a frequency of 6750 cycles/s and a receiver probe. By a simple relationship, the phase changes represent directly the changes in the velocity of sound which, due to well-known changes, are the image of the changes in modulus. The sonic or dynamic modulus is directly proportional to the square of the velocity of sound in the sample over the density of the substance.

Figure 2:
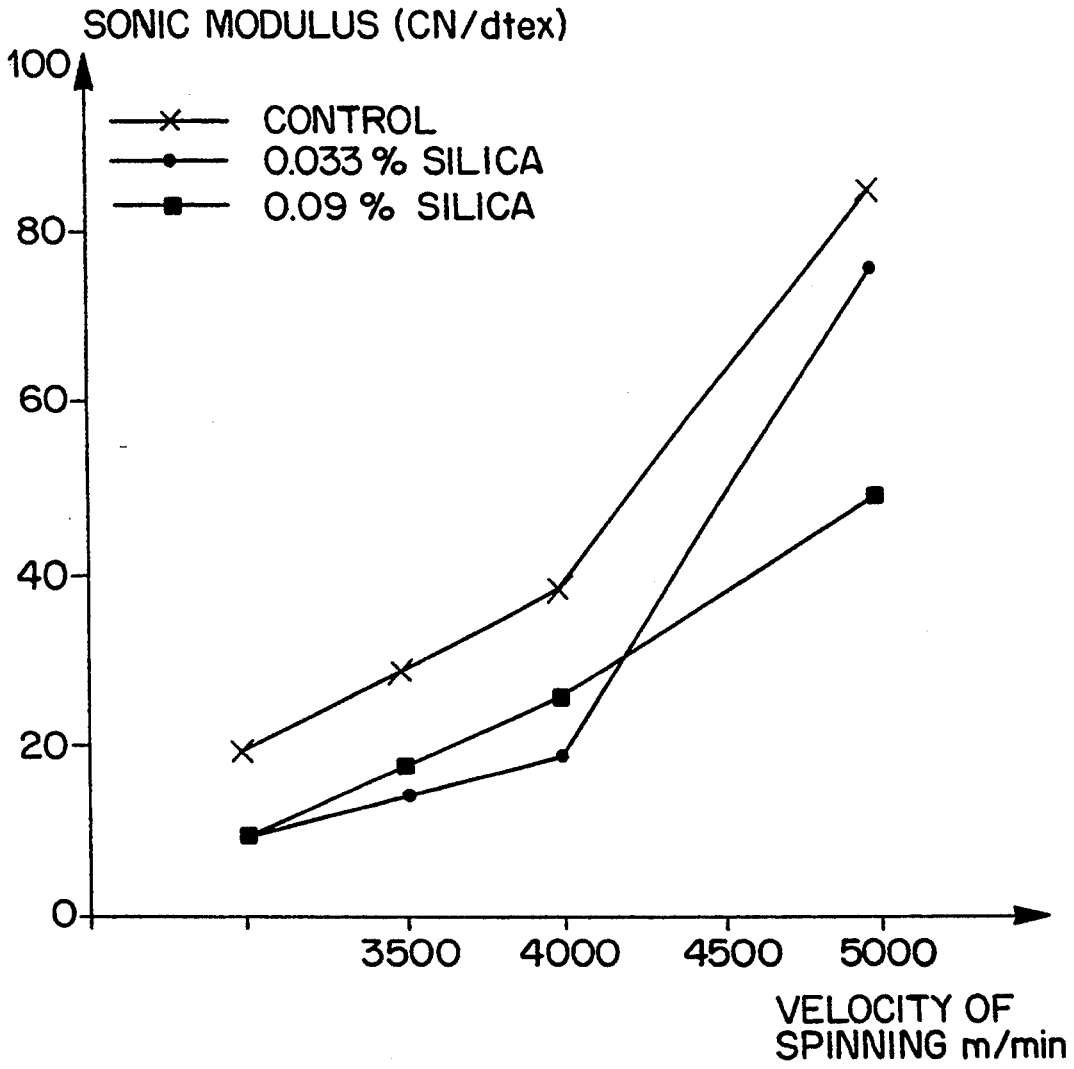
FIG. 2 is a graph showing the shift in sonic modules (CH/dtex) as a function of velocity of spinning for various yarns in accord with the present invention and a control yarn.

The curves shown in FIG. 2 show the shift in the values of the sonic modulus in cN/dtex of silica-filled filaments (0.033 and 0.09%) compared with an unfilled control PET yarn, after heat treatment without stress for 2 min at 100° C.

The present invention thus makes it possible to produce at spinning velocities of between 3500 and 5000 m/min undrawn preoriented POY yarns exhibiting a crystalline structure and an orientation which are delayed (as are the properties linked with this structure of the yarns), corresponding to those of yarns obtained at velocities which are 7%, or even 10 to 15% lower, that is to say to obtain a better production efficiency for PET yarns intended for texturing using false twist and obtained hitherto at velocities which are generally lower than approximately 4000 m/min. Below 3500 m/min it is noted according to the curves that the delay in the crystallization does not allow any major contribution in respect of the structure of the yarns and such velocities are of little interest on an industrial scale. Above 5000 m/rain the yarns obtained become completely oriented and drawn yarns and are no longer suitable for the application in texturing using false twist which is required.

Such silica-filled PET yarns are textured easily and more rapidly than the known preoriented PET yarns using the simultaneous drawing-texturing, spindle or friction processes. Furthermore, they can also be employed for all the textile conversions such as weaving, hitting or the manufacture of nonwoven sheets.

Furthermore, the introduction of silica comprised between 0.03 and 0.1% relative to the polymer does not damage the mechanical properties of the yarns which are needed for satisfactory ultimate use.

The examples which follow are given by way of guidance to illustrate the invention, no limitation being implied.

Having generally described this invention, a further understanding can be obtained by reference to certain specific examples which re provided herein for purposes of illustration only and are not intended to be limited unless otherwise specified.

EXAMPLES

EXAMPLES 1 to 3

A predried PET is employed, with an intrinsic viscosity of 0.67, measured on a solution at a concentration of 0.5% weight by weight in a phenol/tetrachloroethane mixture as shown above.

The PET contains 0.5% by weight of titanium dioxide as delustering agent. It is melted at 285° C. in a twin-screw extruder, to which is added a masterbatch of the same PET containing 2% of fumed silica (known trademark Aerosil 300 from Degussa) in a quantity such that the final polymer mixture contains:

Ex. 1:0.033% of silica

Ex. 2:0.066% of silica

Ex. 3:0.1% of silica

The pyrogenic silica is in the form of aggregates consisting of elementary particles with a specific surface area of 300 $m^2/g$ measured by the BET method (AFNOR Standard N T 45007) whose particle size is between 5–15 nm (50 and 150 Å). The PET mixture containing the silica is spun at 283° C. through a die plate comprising 2 times 7 orifices with a round section 0.34 mm in diameter and in which the height of the orifice is equal to its diameter. The spinning is carried out at a constant flow rate per hole of 13.5 g/min per yarn (7 orifices). The filaments are cooled with a cross stream of air at room temperature driven at a velocity of 50 m/min. The strands are brought together and sized simultaneously at a temperature below the glass transition point. They are interlaced by means of a pneumatic nozzle (2 bars air pressure) and are wound at different velocities: 3500–4000–4500 and 5000 m/min.

The yarns obtained have the following characteristics in comparison with a control yarn obtained identically but without silica.

| Examples | 1) 0.033% | 2) 0.06% | 3) 0.1% | Control |
|---|---|---|---|---|
| | | Count in dtex: | | |
| 3500 | 38.5 | 38.6 | 38.6 | 38.6 |
| 4000 | 33.8 | 33.8 | 33.8 | 33.8 |
| 4500 | 30 | 30 | 30 | 30 |
| 5000 | 27 | 27 | 27 | 27 |
| | | Tenacity at break in cN/tex: | | |
| 3500 | 21.8 | 20.8 | 19.75 | 21.5 |
| 4000 | 24 | 23 | 22.1 | 23.5 |
| 4500 | 23.3 | 22.3 | 21.3 | 27.2 |
| 5000 | 22.6 | 21.5 | 20.45 | 30.9 |
| | | Elongation at break in %: | | |
| 3500 | 115.1 | 115 | 114.65 | 107.75 |
| 4000 | 86.1 | 84 | 82.3 | 74.5 |
| 4500 | 65.2 | 63.8 | 62.3 | 67.7 |
| 5000 | 44.2 | 43.2 | 42.3 | 61 |
| | | Young's modulus: | | |
| 3500 | 204 | 200 | 197 | 220 |
| 4000 | 251 | 251 | 242 | 267 |
| 4500 | 314 | 314 | 310 | 343 |
| 5000 | 377 | 378 | 379 | 418 |
| | | Shrinkage in %: | | |
| 3500 | 49.9 | 50.1 | 51 | 41 |
| 4000 | 34.86 | 36 | 37.8 | 21.9 |
| 4500 | 20.6 | 24.2 | 26.9 | 12.5 |
| 4650 | 14.4 | | 22.4 | 8.6 |
| 5000 | 8.5 | 11.4 | 15.14 | 2.5 |
| | | Gain in production efficiency in %: | | |
| 3500 | 7.46 | 7.5 | 8.4 | |
| 4000 | 9.2 | 10.9 | 11.7 | |
| 4500 | 15.2 | 12.9 | 16.4 | |
| 5000 | 7.8 | 9.8 | 13.8 | |

According to the above values it is noted that the best gains in production efficiency are obtained with the highest silica loads and that the characteristics are not damaged in any way by the said loads. Furthermore, the increase in the shrinkage in comparison with the control yarn is greater than 20%, generally greater than 50%. Such yarns are easily textured on conventional false-twist machines.

We claim:

1. Undrawn preoriented polyester yarns containing 0.03 to 0.1% of fumed silica with a particle size of between 5 and 15 nm, exhibiting a delay in crystallization.

2. Yarns according to claim 1, containing 0.05 to 0.1% of silica.

3. Undrawn preoriented polyester yarns according to claim 1, characterized in that the delay in crystallization, demonstrated by an increase in the shrinkage (measured in dry air at 180° C.) is of at least 20%.

4. Polyester yarns according to claim 1, characterized in that the delay in the crystallization demonstrated by the increase in the shrinkage is of at least 50%.

* * * * *